US011168593B2

(12) United States Patent
Schumann et al.

(10) Patent No.: US 11,168,593 B2
(45) Date of Patent: Nov. 9, 2021

(54) FOUR STROKE ENGINE, HANDHELD WORK APPARATUS HAVING A FOUR STROKE ENGINE, AND METHOD FOR OPERATING A FOUR STROKE ENGINE

(71) Applicant: Andreas Stihl AG & Co. KG, Waiblingen (DE)

(72) Inventors: Florian Schumann, Fellbach (DE); Max Ryssel, Asperg (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/672,166

(22) Filed: Nov. 1, 2019

(65) Prior Publication Data

US 2020/0173319 A1 Jun. 4, 2020

(30) Foreign Application Priority Data

Nov. 30, 2018 (EP) ..... 18209488

(51) Int. Cl.
*F01M 9/04* (2006.01)
*F02B 75/02* (2006.01)
(Continued)

(52) U.S. Cl.
CPC ..... *F01M 9/04* (2013.01); *F02B 75/02* (2013.01); *F02B 75/243* (2013.01); *F01M 1/04* (2013.01); *F02B 2075/027* (2013.01)

(58) Field of Classification Search
CPC ... F01M 9/04; F01M 1/04; F01M 3/00; F02D 41/00; F02D 41/0035; F02D 41/0025;
(Continued)

(56) References Cited

U.S. PATENT DOCUMENTS 5,347,967 A 9/1994 Todero et al.
5,400,591 A * 3/1995 Aramaki ..... F01N 3/22 60/274
(Continued)

FOREIGN PATENT DOCUMENTS

CN 202090981 U 12/2011
DE 20209794 U1 11/2003
(Continued)

*Primary Examiner* — Jacob M Amick
*Assistant Examiner* — Charles J Brauch
(74) *Attorney, Agent, or Firm* — Walter Ottesen, P.A.

(57) ABSTRACT

A mixture-lubricated four stroke engine has a cylinder in which a combustion chamber is formed. The combustion chamber is delimited by a piston which is mounted movably in the cylinder. The engine has an intake channel which discharges into the combustion chamber via an inlet opening controlled by an inlet valve. A mixture formation unit includes at least one fuel opening which discharges into the intake channel. For the lubrication of the crankcase interior, a flow connection connects the intake channel to the crankcase interior via a connecting opening which discharges into the intake channel downstream of the mixture formation unit. The fuel quantity is controlled by a fuel valve. A control unit is configured to activate the fuel valve in a manner dependent on the position of the crankshaft such that the fuel valve is opened at least also during a part of the compression stroke.

13 Claims, 3 Drawing Sheets

(51) Int. Cl.
*F02B 75/24* (2006.01)
*F01M 1/04* (2006.01)

(58) Field of Classification Search
CPC ..... F02M 17/38; F02M 37/0023; F02M 7/12; F02B 63/02; F02B 75/02; F02B 75/243; F02B 2075/027; F02B 33/04; F02B 33/26
See application file for complete search history.

(56) References Cited

U.S. PATENT DOCUMENTS 6,085,729 A * 7/2000 Kondo ..... F02D 41/04 123/478
6,199,532 B1 3/2001 Haeberlein et al.
2003/0233993 A1 12/2003 Radel
2007/0039574 A1* 2/2007 Borchardt ..... F01M 3/00 123/65 VD
2007/0277776 A1* 12/2007 Thomas ..... F02D 41/062 123/299
2011/0004395 A1 1/2011 Neubauer et al.
2014/0041634 A1* 2/2014 Hu ..... F02M 41/00 123/456
2014/0096743 A1* 4/2014 Meacham ..... F01L 13/06 123/345
2014/0299099 A1 10/2014 Yoshizaki et al.
2015/0020772 A1* 1/2015 Eberle ..... F02D 41/34 123/344
2016/0017820 A1* 1/2016 Arai ..... F02M 19/06 123/438
2016/0201593 A1* 7/2016 Berkemeier ..... F02M 69/046 123/299
2016/0369735 A1* 12/2016 Zhou ..... F01N 3/101

FOREIGN PATENT DOCUMENTS

DE 102009031707 A1 1/2011
EP 2787194 A2 10/2014
JP H06146837 A 5/1994
JP H08189322 A 7/1996
JP H1018914 A 1/1998
JP 2011231753 A 11/2011
WO WO-2014167649 A1 * 10/2014 ..... F02D 41/024

* cited by examiner

FOUR STROKE ENGINE, HANDHELD WORK APPARATUS HAVING A FOUR STROKE ENGINE, AND METHOD FOR OPERATING A FOUR STROKE ENGINE

CROSS REFERENCE TO RELATED APPLICATION

This application claims priority of European patent application no. 18 209 488.8, filed Nov. 30, 2018, the entire content of which is incorporated herein by reference.

FIELD OF THE INVENTION

The invention relates to a four stroke engine, to a handheld work apparatus having a four stroke engine, and to a method for operating a four stroke engine.

BACKGROUND OF THE INVENTION

U.S. Pat. No. 6,199,532 has disclosed a four stroke engine which is mixture-lubricated. For the lubrication of the crankcase, a flow connection is provided which connects the intake channel to the crankcase. For the feed of fuel into the intake channel, a mixture formation unit is provided. Such mixture formation units are conventionally carburetors, in the case of which the fuel quantity fed to the intake channel is dependent on the negative pressure prevailing in the intake channel.

SUMMARY OF THE INVENTION

It is an object of the invention to provide a four stroke engine which is mixture-lubricated and which permits improved control of the fed fuel quantity with good lubrication of the crankcase. It is a further object of the invention to provide a handheld work apparatus having a four stroke engine. It is a further object of the invention to provide a method for operating a four stroke engine.

The object can, for example, be achieved with regard to the four stroke engine via a four stroke engine which is mixture-lubricated, with a cylinder in which a combustion chamber is formed, the combustion chamber being delimited by a piston which is mounted movably in the cylinder, the piston driving a crankshaft, which is mounted rotatably in a crankcase interior, in rotation, the four stroke engine having an intake channel which discharges into the combustion chamber via an inlet opening controlled by an inlet valve, an outlet channel controlled by an outlet valve leading out of the combustion chamber, with a mixture formation unit, the mixture formation unit including at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, wherein the fuel quantity fed to the fuel opening is controlled by a fuel valve, and wherein the four stroke engine has a control unit, the control unit being configured to activate the fuel valve in a manner dependent on the position of the crankshaft such that the fuel valve is opened at least also during a part of a compression stroke of the four stroke engine.

With regard to the work apparatus, the object can, for example, be achieved via a work apparatus having a four stroke engine, the four stroke engine being mixture-lubricated, with a cylinder in which a combustion chamber is formed, the combustion chamber being delimited by a piston which is mounted movably in the cylinder, the piston driving a crankshaft, which is mounted rotatably in a crankcase interior, in rotation, the four stroke engine having an intake channel which discharges into the combustion chamber via an inlet opening controlled by an inlet valve, an outlet channel controlled by an outlet valve leading out of the combustion chamber, with a mixture formation unit, the mixture formation unit including at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, the fuel quantity fed to the fuel opening being controlled by a fuel valve, and the four stroke engine having a control unit, the control unit being configured to activate the fuel valve in a manner dependent on the position of the crankshaft such that the fuel valve is opened at least also during a part of a compression stroke of the four stroke engine, and the four stroke engine rotating at a rotational speed of 5,000 to 11,000 revolutions per minute at full load.

The object can, for example, be achieved via a four stroke engine which is mixture-lubricated, with a cylinder in which a combustion chamber is formed, the combustion chamber being delimited by a piston which is mounted movably in the cylinder, the piston driving a crankshaft, which is mounted rotatably in a crankcase interior, in rotation, the four stroke engine having an intake channel which discharges into the combustion chamber via an inlet opening controlled by an inlet valve, an outlet channel controlled by an outlet valve leading out of the combustion chamber, with a mixture formation unit, the mixture formation unit including at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, wherein the fuel quantity fed to the fuel opening is controlled by a fuel valve, and wherein the four stroke engine has a control unit, the control unit being configured to activate the fuel valve in a manner dependent on the position of the crankshaft such that the fuel valve is opened at least also during a part of an exhaust stroke of the four stroke engine.

With regard to the work apparatus, the object can, for example, also be achieved via a work apparatus having a four stroke engine, the four stroke engine being mixture-lubricated, with a cylinder in which a combustion chamber is formed, the combustion chamber being delimited by a piston which is mounted movably in the cylinder, the piston driving a crankshaft, which is mounted rotatably in a crankcase interior, in rotation, the four stroke engine having an intake channel which discharges into the combustion chamber via an inlet opening controlled by an inlet valve, an outlet channel controlled by an outlet valve leading out of the combustion chamber, with a mixture formation unit, the mixture formation unit including at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, the fuel quantity fed to the fuel opening being controlled by a fuel valve, and the four stroke engine having a control unit, the control unit being configured to activate the fuel valve in a manner dependent on the position of the crankshaft such that the fuel valve is opened at least also during a part of an exhaust stroke of the four stroke engine, and the four stroke engine rotating at a rotational speed of 5,000 to 11,000 revolutions per minute at full load.

With regard to the method, the object can, for example, be achieved via a method for operating a four stroke engine, the four stroke engine being mixture-lubricated, with a cylinder in which a combustion chamber is formed, the combustion chamber being delimited by a piston which is mounted movably in the cylinder, the piston driving a crankshaft, which is mounted rotatably in a crankcase interior, in rotation, the four stroke engine having an intake channel which discharges into the combustion chamber via an inlet opening controlled by an inlet valve, an outlet channel controlled by an outlet valve leading out of the combustion chamber, with a mixture formation unit, the mixture formation unit including at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, wherein the fuel quantity fed to the fuel opening is controlled by a fuel valve, and wherein the fuel valve is activated in a manner dependent on the position of the crankshaft such that the fuel valve is opened at least also during a part of a compression stroke of the four stroke engine.

With regard to the method, the object can, for example, also be achieved via a method for operating a four stroke engine, the four stroke engine being mixture-lubricated, with a cylinder in which a combustion chamber is formed, the combustion chamber being delimited by a piston which is mounted movably in the cylinder, the piston driving a crankshaft, which is mounted rotatably in a crankcase interior, in rotation, the four stroke engine having an intake channel which discharges into the combustion chamber via an inlet opening controlled by an inlet valve, an outlet channel controlled by an outlet valve leading out of the combustion chamber, with a mixture formation unit, the mixture formation unit including at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, wherein the fuel quantity fed to the fuel opening is controlled by a fuel valve, and wherein the fuel valve is activated in a manner dependent on the position of the crankshaft such that the fuel valve is opened at least also during a part of an exhaust stroke of the four stroke engine.

An aspect of the invention provides for the fuel quantity fed to the fuel opening to be controlled by a fuel valve. In this way, the fuel quantity fed to the combustion engine can be controlled more precisely than, for example, with a fuel feed in the case of which the fuel quantity drawn in is exclusively dependent on the negative pressure in the intake channel. This is the case, for example, with carburetors which operate without a controlled fuel valve. To ensure sufficient lubrication of the crankcase, provision is made whereby the control unit of the four stroke engine is configured to activate the fuel valve in a manner dependent on the position of the crankshaft. The opening time and the closing time of the fuel valve are accordingly selected not only in a manner dependent on the fuel quantity to be fed but also in a manner dependent on the position of the crankshaft, that is, in a manner dependent on the crankshaft angle. Here, provision is made whereby the fuel valve is opened at least also during a part of the compression stroke of the four stroke engine. During the compression stroke, the pressure in the combustion chamber increases, and the inlet valve closes shortly after the start of the compression stroke. It has now been found that, by virtue of the fuel valve being opened at least also during a part of the compression stroke of the four stroke engine, an improved intake of fuel into the crankcase interior can be achieved via the flow connection. By contrast, if the fuel valve is opened only before and/or during the intake stroke, the fuel fed into the intake channel passes substantially, in particular almost entirely, into the combustion chamber, such that sufficient lubrication of the crankcase cannot be ensured. If the fuel valve is opened and closed independently of the position of the crankshaft, this results in intense fluctuations of the mixture composition in the combustion chamber, which lead to uneven running of the four stroke engine.

The intake stroke of the four stroke engine is the stroke in which the piston increases the size of the volume of the combustion chamber and the inlet valve is opened at least temporarily, in particular over the entire stroke. The compression stroke is the stroke in which the piston reduces the size of the volume of the combustion chamber and in which the outlet valve is closed. The inlet valve is also at least temporarily closed in the compression stroke. The power stroke is the stroke in which the piston increases the size of the volume of the combustion chamber and the inlet valve is closed. A combustion is performed in the combustion chamber at the end of the compression stroke or at the start of the power stroke. The exhaust stroke is the stroke in which the outlet valve is opened and the piston reduces the size of the volume of the combustion chamber, whereby exhaust gases are discharged through the outlet. Intake stroke, compression stroke, power stroke and exhaust stroke follow one another in the stated sequence.

It is advantageous if, in each engine cycle, the fuel valve is opened both during a part of the intake stroke and during at least a part of the compression stroke. In an embodiment, the fuel valve opens during the compression stroke and is opened during the power stroke, the exhaust stroke and at least a part of the intake stroke. Depending on the fuel quantity to be fed, the fuel valve may however also be closed during the power stroke and the exhaust stroke. The fuel valve is advantageously opened at least once during every opening time interval of the inlet valve. A sufficient fuel feed into the combustion chamber is ensured in this way. It is advantageous if, in each engine cycle, at least 20% of the opening time interval of the fuel valve lies in the compression stroke. It has been found that good lubrication of the moving parts in the crankcase interior can be achieved in this way.

In an embodiment, the mixture formation unit is a carburetor. The carburetor has at least one fuel opening which is fed by a fuel channel. The fuel quantity flowing through the fuel channel can advantageously be controlled by the fuel valve. The fuel opening can preferably be arranged in the region of a venturi section of the carburetor, and the fuel is drawn into the intake channel owing to the negative pressure prevailing in the intake channel when the fuel valve is opened. Accordingly, fuel is not injected into the intake channel but is drawn in. The fuel valve can be an electromagnetic valve. In an embodiment, the fuel valve is open when in the electrically deenergized state. In an alternative embodiment, provision may also be made whereby the fuel valve is closed when in the electrically deenergized state.

The inlet valve and the outlet valve can advantageously be activated via a valve drive in a manner dependent on the position of the crankshaft. The valve drive may include pushrods which act on levers for actuating inlet valve and outlet valve. In an alternative embodiment, the valve drive may include a drive pinion and a driven wheel, which are coupled to one another by a transmission means such as for example a chain, a belt or the like, wherein the driven wheel drives a camshaft, which actuates inlet valve and outlet valve. In a further alternative embodiment, the valve drive may be configured as a toothed-wheel gearing. Other known embodiments for the valve drive may also be advantageous. The valve drive can advantageously be arranged in a valve drive chamber, wherein at least a part of the valve drive chamber forms at least a part of the flow connection. In this way, the valve drive is lubricated by the mixture flowing from the intake channel into the crankcase interior and back. Separate lubrication for the valve drive can thereby be omitted. In an advantageous embodiment, the valve drive is configured as a lever-type drive, and the valve drive chamber includes a lever chamber and at least one connecting channel which form parts of the flow connection. The lever chamber can advantageously be connected via at least one connecting opening to the intake channel. In an alternative embodiment, a connecting opening may be provided which connects the intake channel to the connecting channel or to a cam chamber of the four stroke engine. The connecting opening to the intake channel may in this case be permanently open or may for example be controlled in a manner dependent on the rotational speed.

In an alternative embodiment, provision is made whereby the fuel valve is opened at least also during a part of the exhaust stroke of the four stroke engine. The inlet valve opens during the exhaust stroke. It has now been found that, by virtue of the fuel valve being opened at least also during a part of the exhaust stroke of the four stroke engine, an improved intake of fuel into the crankcase interior can be achieved via the flow connection. Here, the fuel valve is advantageously at least partially opened whilst the inlet valve is closed.

For a handheld work apparatus having a four stroke engine, provision is advantageously made whereby the four stroke engine rotates at a rotational speed of 5,000 to 11,000 revolutions per minute at full load. It has been found that, in particular in a rotational speed range from 5,000 to 11,000 revolutions per minute, sufficient lubrication of the crankcase interior can be ensured even at full load via the provided opening of the fuel valve also during a part of the compression stroke. The four stroke engine preferably rotates at a rotational speed of 5,000 to 9,000 revolutions per minute at full load. If the opening and closing times of the fuel valve are not adapted to the engine stroke in the case of such relatively low full-load rotational speeds, this can result in an insufficient fuel supply and thus uneven running of the combustion engine and insufficient lubrication of the crankcase interior.

For a method for operating a mixture-lubricated four stroke engine with a cylinder in which a combustion chamber is formed, the combustion chamber being delimited by a piston which is mounted movably in the cylinder, the piston driving a crankshaft, which is mounted rotatably in a crankcase interior, in rotation, the four stroke engine having an intake channel which discharges into the combustion chamber via an inlet opening controlled by an inlet valve, an outlet channel controlled by an outlet valve leading out of the combustion chamber, with a mixture formation unit, the mixture formation unit including at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, provision is made whereby the fuel quantity fed to the fuel opening is controlled by a fuel valve, and whereby the fuel valve is activated in a manner dependent on the position of the crankshaft such that the fuel valve is opened at least also during a part of the compression stroke of the four stroke engine.

Alternatively, for a method for operating a mixture-lubricated four stroke engine with a cylinder in which a combustion chamber is formed, the combustion chamber being delimited by a piston which is mounted movably in the cylinder, the piston driving a crankshaft, which is mounted rotatably in a crankcase interior, in rotation, the four stroke engine having an intake channel which discharges into the combustion chamber via an inlet opening controlled by an inlet valve, an outlet channel controlled by an outlet valve leading out of the combustion chamber, with a mixture formation unit, the mixture formation unit including at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, provision is made whereby the fuel quantity fed to the fuel opening is controlled by a fuel valve, and whereby the fuel valve is activated in a manner dependent on the position of the crankshaft such that the fuel valve is opened at least also during a part of the exhaust stroke of the four stroke engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
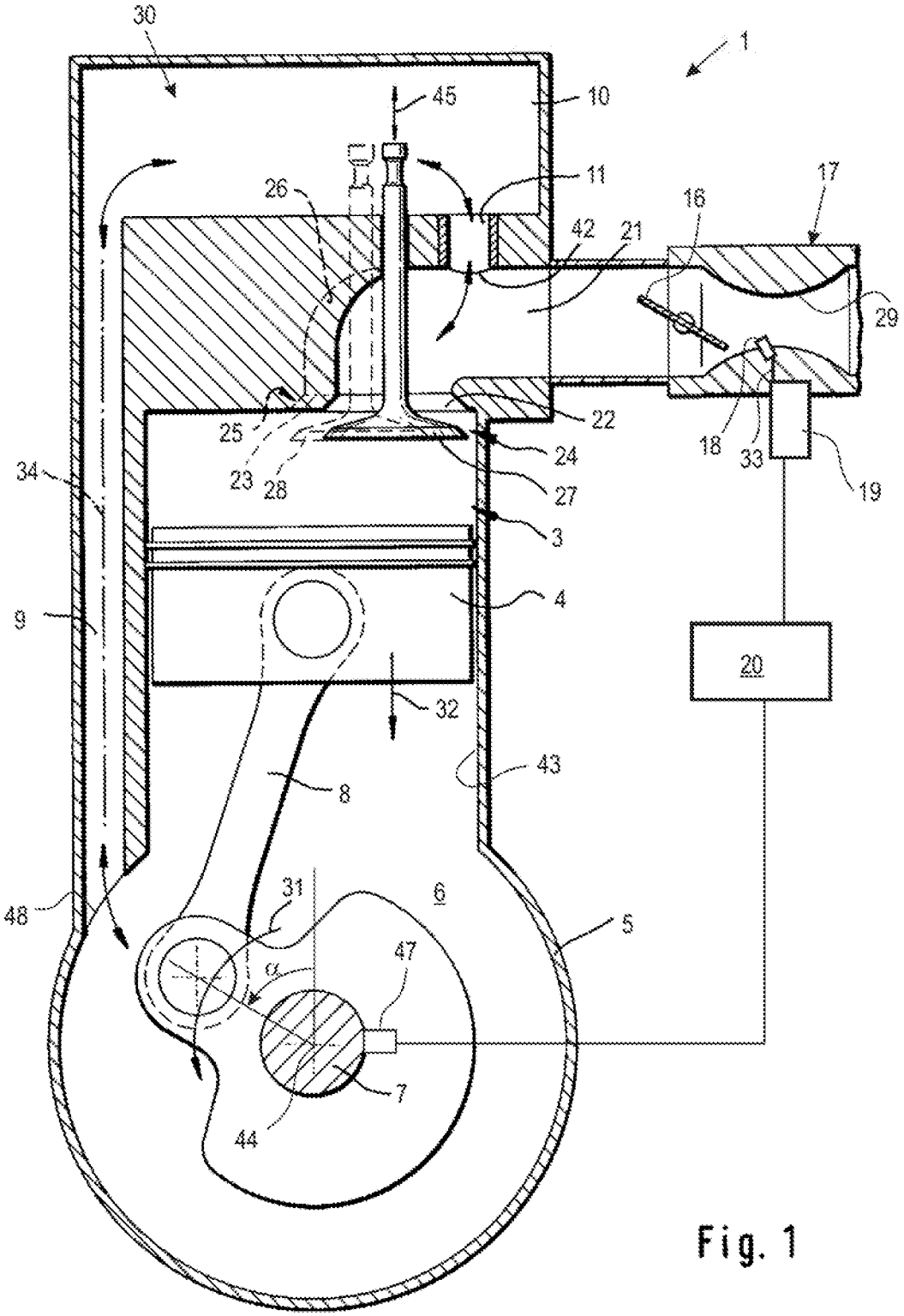
FIG. 1 and FIG. 2 are schematic sectional illustrations of a two stroke engine.
Figure 4:
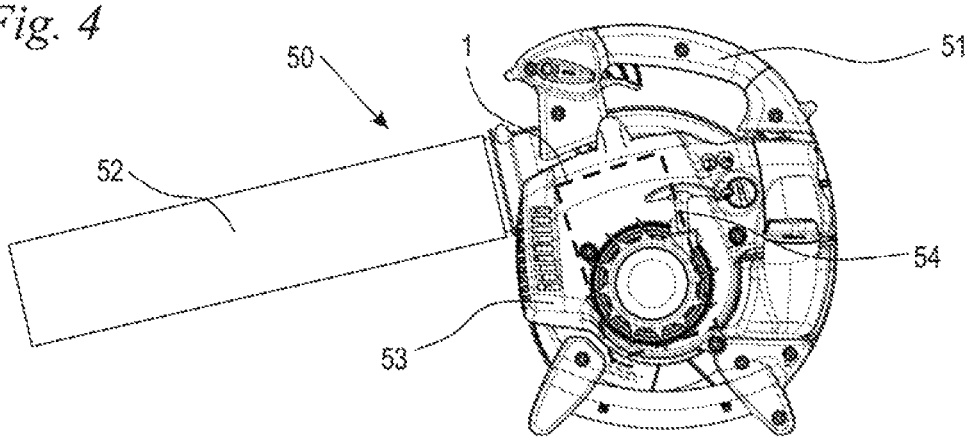

FIG. 1 schematically shows a four stroke engine 1, which may serve for driving the tool in a handheld work apparatus. The handheld work apparatus may for example be a motorized chainsaw, a parting grinder, a brushcutter or the like. FIG. 4 illustrates a handheld blower apparatus 50 as an embodiment of a work apparatus. The tool of a blower apparatus 50 is a blower impeller (not illustrated) which conveys a working air stream through a blower tube 52. The blower apparatus 50 has a handle 51 via which the blower apparatus 50 can be guided. The blower apparatus 50 furthermore has a housing 53 in which the four stroke engine 1 schematically illustrated in FIG. 1 is arranged. A starter device (not illustrated specifically), in particular a pull-rope starter, the starter handle 54 of which projects out of the housing 53, serves for the starting of the four stroke engine 1. The four stroke engine can preferably be configured for being started manually by an operator.

As shown in FIG. 1, the four stroke engine 1 has a cylinder 2 in which a combustion chamber 3 is formed. The combustion chamber 3 is delimited by a piston 4 which is mounted so as to be movable in reciprocating fashion, in a cylinder bore 43 of the cylinder 2. FIG. 1 shows the four stroke engine 1 during the downward stroke of the piston 4, during which the piston 4 moves in the direction of an arrow 32. During the downward stroke of the piston 4, the volume of the combustion chamber 3 increases in size. During the upward stroke of the piston 4, during which the piston moves counter to the direction of the arrow 32, the volume of the combustion chamber 3 decreases in size.

The piston 4 drives, via a connecting rod 8, a crankshaft 7 which is mounted rotatably in a crankcase 5. The crankshaft 7 is mounted so as to be rotatable about a rotational axis 44. During operation, the crankshaft 7 rotates in the direction of an arrow 31. The rotational position of the crankshaft 7 is specified as crankshaft angle α. The crankshaft angle α is 0° at the top dead center of the piston 4 and is 180° at the bottom dead center of the piston 4. A crankcase interior 6 is formed in the crankcase 5. The four stroke engine 1 has an intake channel 21 for the feed of fuel/air mixture.

In the embodiment, a portion of the intake channel 21 is formed in a mixture formation unit 17. The mixture formation unit 17 can advantageously be a carburetor. The mixture formation unit 17 has a venturi section 29, in which a fuel opening 18 discharges into the intake channel 21. The fuel opening 18 is connected via a fuel channel 33 to a fuel valve 19, to which fuel is fed from a fuel tank (not illustrated). The fuel valve 19 controls the fuel quantity fed to the fuel opening 18. The fuel valve 19 can advantageously be an electromagnetic valve.

The fuel valve 19 is activated by a control unit 20. The activation of the fuel valve 19 is performed in a manner dependent on the rotational position of the crankshaft 7, that is, in a manner dependent on the crankshaft angle α. The control unit 20 is configured such that the fuel valve 19 can be activated in the corresponding manner adapted to the engine cycle. For this purpose, the control unit 20 is equipped with a rotational position detector 47 for detecting the rotational position of the crankshaft 7, that is, for detecting the crankshaft angle α. The rotational position detector 47 may for example have at least one sensor for detecting the rotational position of the crankshaft 7. The rotational position detector 47 may however also determine the rotational position of the crankshaft 7, that is, the crankshaft angle α, from other signals, for example the voltage induced in an ignition device of the four stroke engine 1 or the voltage induced in a generator of the four stroke engine 1 or a combination of multiple signals. A detection of the rotational position of the crankshaft 7 from other signals, for example with the aid of the pressure prevailing in the crankcase interior 6, may also be provided. In an embodiment, the fuel valve 19 is a valve which is open when electrically deenergized. In an alternative embodiment, the fuel valve 19 may also be a fuel valve which is closed when electrically deenergized.

A throttle element 16, in the embodiment a throttle flap, is mounted pivotably in the intake channel downstream of the fuel opening 18. Via the throttle element 16, an operator can adjust the quantity of fuel/air mixture that is drawn in through the intake channel 21.

The intake channel 21 discharges with an inlet opening 22 into the combustion chamber. The inlet opening 22 is controlled by an inlet valve 24. For this purpose, the inlet valve 24 is movable in the direction of a double arrow 45. The inlet valve 24 has a valve disk 27 which opens up or closes off the inlet opening 22 in a manner dependent on the position of the inlet valve 24. Leading out of the combustion chamber 3 is an outlet opening 23 which is opened or closed by a valve disk 28 of an outlet valve 25. The outlet opening 23 is adjoined by an outlet channel 26, by which exhaust gases flow out of the combustion chamber 3. An exhaust silencer (not illustrated) can advantageously be connected to the outlet channel 26.

To control the opening and closing times of inlet valve 24 and outlet valve 25, a valve drive 34 is provided, which is schematically indicated in FIG. 1 and which is described in detail with reference to FIG. 2. The valve drive 34 is arranged in a valve drive chamber 30. The intake channel 21 is connected to the crankcase interior 6 via a flow connection. In the embodiment, the flow connection includes the valve drive chamber 30 and a connecting opening 11. As shown in FIG. 1, the connecting opening 11 discharges with a discharge opening 42 into the intake channel 21. The discharge opening 42 is arranged downstream of the throttle element 16. The valve drive chamber 30 includes a lever chamber 10 and at least one connecting channel 9, which in the embodiment is connected via a further connecting opening 48 to the crankcase interior 6.

Figure 2:
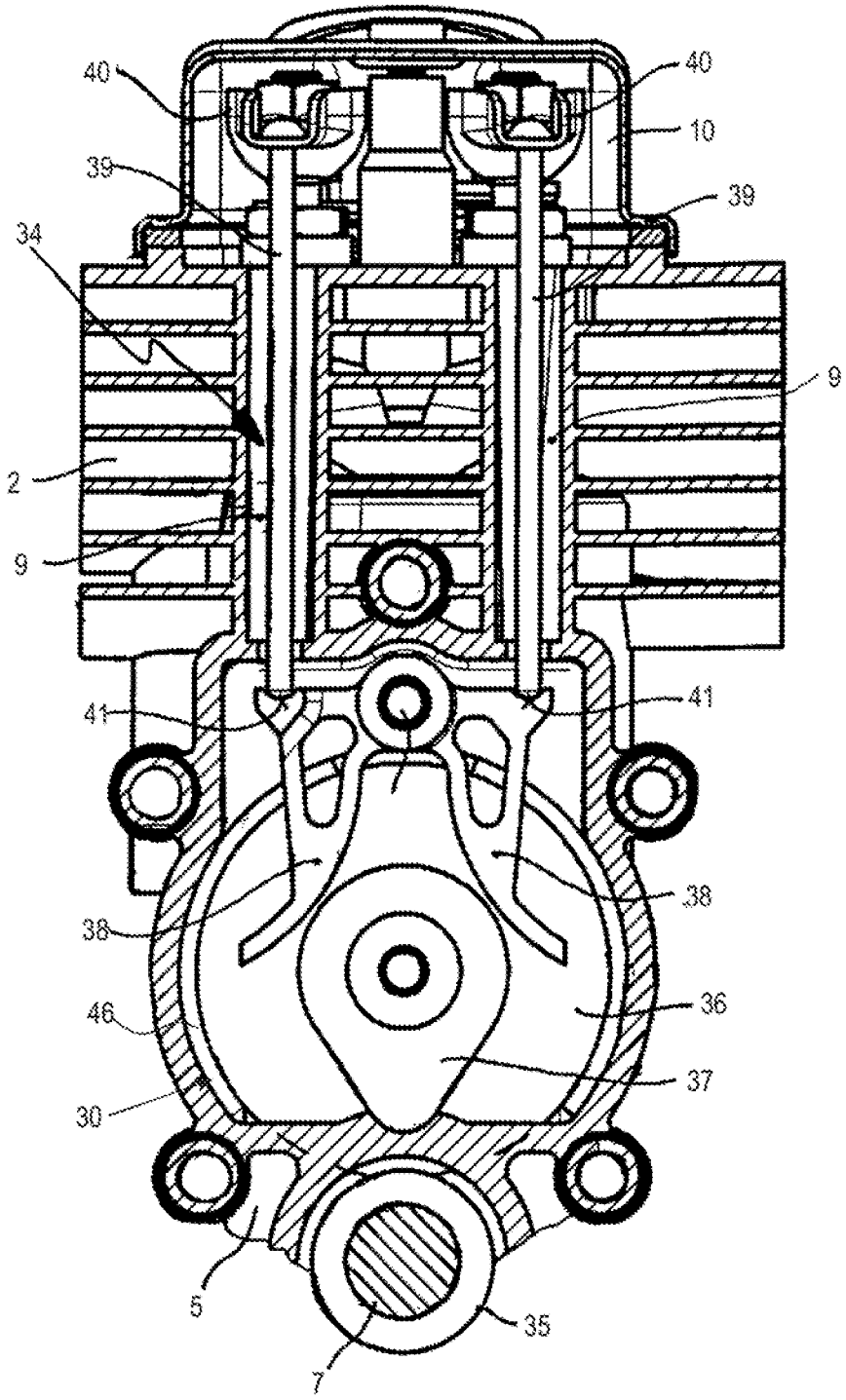

FIG. 2 schematically shows one possible configuration variant for the embodiment of the valve drive 34. In the embodiment, a drive pinion 35 is connected rotationally conjointly to the crankshaft 7, which drive pinion meshes with a driven wheel 36. The diameter of the driven wheel 36 is considerably greater than that of the drive pinion 35, such that drive pinion 35 and driven wheel 36 form a reduction gearing. Fixed to the driven wheel 36 is a cam 37, against which two rocker arms 38 bear. The driven wheel 36 and the cam 37 advantageously rotate at half of the rotational speed of the crankshaft 7. On each rocker arm 38, there is formed a support 41 against which a pushrod 39 bears. The pushrods 39 actuate in each case one lever 40. The levers 40 are arranged in the lever chamber 10 and in turn actuate the plungers of inlet valve 24 and outlet valve 25. The valves 24 and 25 (FIG. 1) are in this case mounted so as to be spring-loaded in the direction of their closed position and are moved in the direction of their opened position by the levers 40 when the pushrods 39 move further away from the crankcase 5 into the lever chamber 10. The pushrods 39 run through the connecting channels 9. The driven wheel 36, the cam 37 and the rocker arm 38 are arranged in a cam chamber 46. The cam chamber 46 is connected to the crankcase interior 6 via the connecting opening 48 that is schematically illustrated in FIG. 1.

Figure 3:
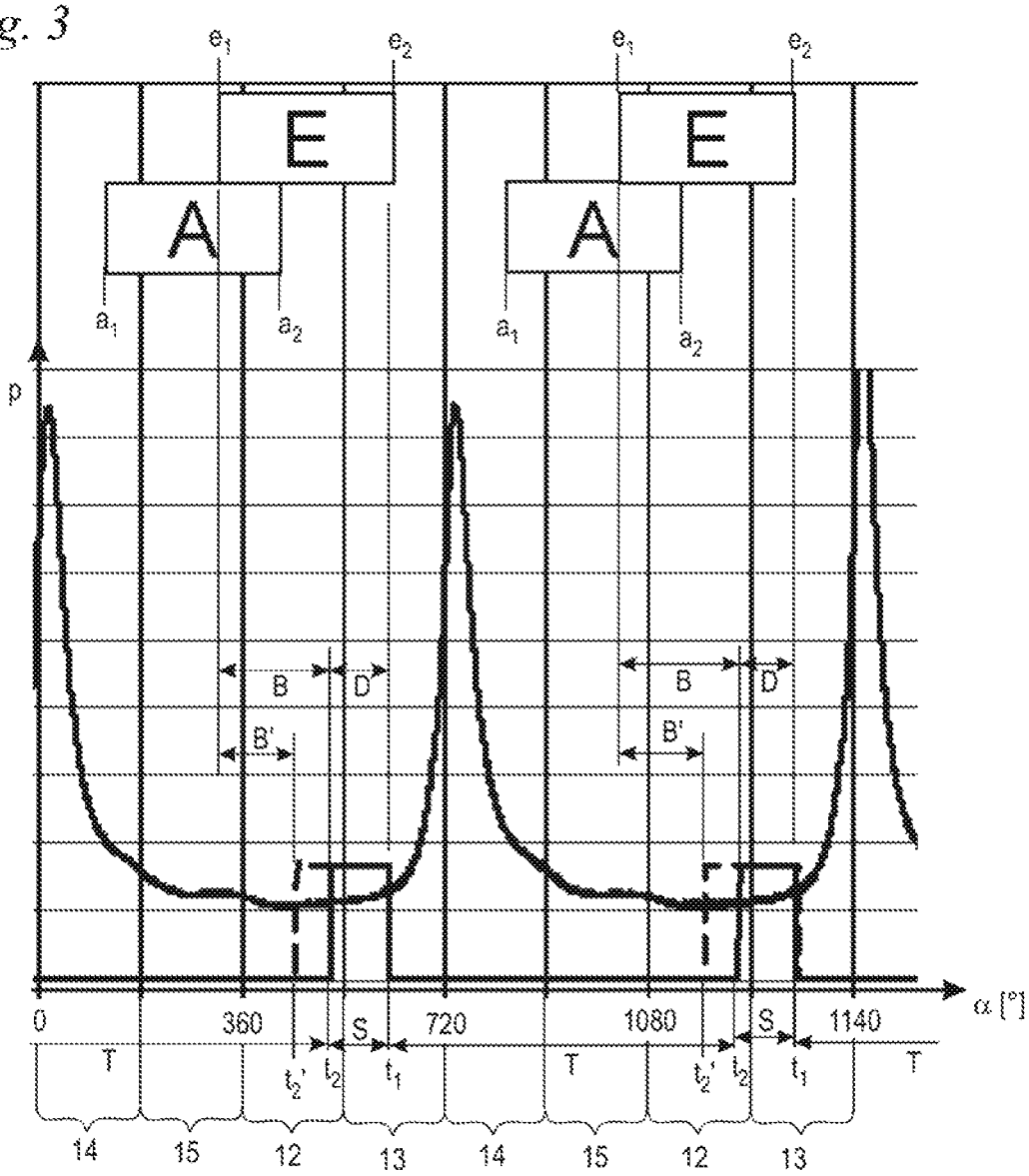
FIG. 3 is a schematic illustration of the pressure in the combustion chamber, the opening and closing times of the fuel valve and the opening and closing times of inlet valve and outlet valve versus the crankshaft angle; and, FIG. 4 shows a side view of a blower apparatus.

FIG. 3 schematically shows the course of the pressure p in the combustion chamber 3, the opening time interval A of the outlet valve, the opening time interval E of the inlet valve and the opening time interval T of the fuel valve 19 versus the crankshaft angle α. Here, FIG. 3 shows the course over two engine cycles. Here, each engine cycle includes a power stroke 14, an exhaust stroke 15, an intake stroke 12 and a compression stroke 13, which follow one another in the stated sequence.

At the start of the power stroke 14, inlet valve 24 and outlet valve 25 are closed. In the embodiment, the pressure p in the combustion chamber 3 reaches its maximum at the start of the power stroke 14 and thereupon drops sharply. The pressure maximum arises owing to the combustion of fuel/air mixture that has previously taken place in the combustion chamber 3. During the power stroke 14, the piston 4 moves in the direction from the combustion chamber 3 to the crankcase interior 6, that is, in the direction of the arrow 32 in FIG. 1. The piston 4 performs a downward stroke, wherein the volume of the combustion chamber 3 increases in size. The pressure decreases owing to the volume increasing in size in the combustion chamber 3.

The bottom dead center of the piston 4 is reached at a crankshaft angle of 180°. The exhaust stroke 15 extends in a range of the crankshaft angle α from 180° to 360° in the diagram in FIG. 3. During the exhaust stroke 15, the piston 4 moves in an upward stroke from the crankcase interior 6 in the direction of the combustion chamber 3. Here, the piston 4 increases the size of the volume of the crankcase interior 6 and decreases the size of the volume of the combustion chamber 3.

The opening time interval A of the outlet valve is illustrated in FIG. 3 by a block which begins at an opening time $a_1$ and ends at a closing time $a_2$. The opening time interval E of the inlet valve 24 is illustrated in FIG. 3 by a block which begins at an opening time $e_1$ and ends at a closing time $e_2$.

The outlet valve 25 opens at the opening time $a_1$, which lies in the second half of the power stroke 14. As a result, exhaust gases flow out of the combustion chamber 3 through the opened outlet opening 23 into the outlet channel 26. During the exhaust stroke 15, the piston 4 displaces the exhaust gases through the outlet opening 23. The outlet valve 25 is fully open during the exhaust stroke 15.

The outlet valve 25 closes at a closing time $a_2$, which lies in the intake stroke 12 that follows the exhaust stroke 15. During the intake stroke 12, the piston 4 moves in a downward stroke from the combustion chamber 3 in the direction of the crankcase interior 6. The pressure p in the combustion chamber 3 is low, such that the fuel/air mixture is drawn from the intake channel 21 into the combustion chamber 3 through the opened inlet opening 22. The inlet valve 24 opens at the opening time $e_1$, which in the embodiment lies in the second half of the exhaust stroke 15. The inlet valve 24 is fully open during the intake stroke 12. The inlet valve 24 closes at a closing time $e_2$, which lies in the compression stroke 13. The compression stroke 13 follows the intake stroke 12. In the compression stroke 13, the piston 4 moves from the crankcase interior 6 in the direction of the combustion chamber 3 and thereby compresses the fuel/air mixture arranged in the combustion chamber 3. As soon as the inlet valve 24 has closed, the pressure in the combustion chamber 3 increases sharply, as shown in FIG. 2. Subsequently, the mixture is ignited at the end of the compression stroke 13, and the piston is accelerated in the direction of the crankcase interior 6, as already described with regard to the first engine cycle.

In the embodiment, the fuel valve 19 opens at an opening time $t_1$ and closes at a closing time $t_2$. In FIG. 3, this is schematically illustrated by the feed of energy to the fuel valve 19, which is open when electrically deenergized. Energy is fed to the fuel valve 19 whilst the fuel valve 19 is closed, in the embodiment over a closing time interval S which extends from the closing time $t_2$ to the subsequent opening time $t_1$. In an alternative embodiment, the fuel valve 19 is a fuel valve 19 which is closed when electrically deenergized.

In the embodiment, the opening time $t_1$ lies in the compression stroke 13. In the embodiment, the fuel valve 19 opens at an opening time $t_1$ which is simultaneous with the closing time $e_2$ at which the inlet opening 22 closes. In the compression stroke 13, the piston 4 moves in an upward stroke. The volume of the crankcase interior 6 thus increases in size. Since the inlet valve 24 is closed, the fuel/air mixture is drawn from the intake channel 21 via the valve drive chamber 30 into the crankcase interior 6. Effective lubrication of the moving parts in the crankcase interior 6 is thus realized. It is advantageous if, in each engine cycle, at least 20%, in particular at least 30%, preferably at least 40%, of the opening time interval T of the fuel valve 19 lies in the compression stroke 13. The fuel valve 19 is advantageously open over at least 20%, in particular at least 30%, preferably at least 40%, of the compression stroke 13. In the embodiment, the fuel valve 19 is open over more than half of the compression stroke 13.

In the embodiment, the fuel valve 19 remains open until a time $t_2$ which lies in the intake stroke 12. The fuel valve 19 is accordingly advantageously open over the entire power stroke 14 and the entire exhaust stroke 15. Owing to the pulsation of the mixture in the intake channel 21, it is also possible during this time for the fuel/air mixture in the valve drive chamber 30 to be conveyed into the crankcase interior 6. The pulsation in the intake channel 21 arises for example owing to the change in volume of the crankcase interior 6 as the piston 4 moves.

The fuel valve 19 is open at least over a part of the exhaust stroke 15. In an alternative embodiment, provision may be made whereby the fuel valve 19 is open not over the entire exhaust stroke 15 but only over a part of the exhaust stroke 15. The fuel valve 19 advantageously opens in the exhaust stroke 15 and is open over at least a part of the intake stroke 12. The fuel valve 19 opens in particular during the exhaust stroke 15 at a time at which the inlet valve 24 is still closed. In this configuration variant, the time $t_1$ at which the fuel valve 19 opens advantageously lies in the exhaust stroke 15 and before the opening time $e_1$ at which the inlet valve 24 opens. In this way, it can be ensured that fuel is drawn into the crankcase interior 6 via the flow connection.

In the embodiment, the closing time $t_2$ lies toward the end of the intake stroke 12. The richness of the fuel/air mixture flowing into the combustion chamber can be set via the position of the closing time $t_2$ during the intake stroke 12. The fuel valve 19 is closed during the end of the intake stroke 12 and the beginning of the compression stroke 13. The inlet valve 24 is open during this time interval. The opening time interval E of the inlet valve 24 and the closing time interval S during which the fuel valve 19 is closed accordingly overlap over a time interval D. Over a time interval B, both the inlet valve 24 and the fuel valve 19 are open.

FIG. 3 schematically shows a further alternative closing time $t_2'$ for the fuel valve 19, which lies earlier than the closing time $t_2$. As shown in FIG. 3, the alternative closing time $t_2'$ lies shortly after the closing time $a_2$ of the outlet valve 25. The time interval B' during which both the inlet valve 24 and the fuel valve 19 are open is shorter than the time interval B in an operating state of the four stroke engine 1 in which the fuel valve 19 closes for the first time at the closing time $t_2$. The fuel quantity that is fed can be adapted to the operating state of the four stroke engine 1 via the position of the closing time $t_2$, $t_2'$.

Sufficient lubrication of the crankcase interior 6 is ensured by virtue of the fuel valve 19 being open at least also during a part of the compression stroke 13 of the four stroke engine 1. The fuel valve 19 is in this case advantageously open, in every engine cycle, both during a part of the intake stroke 12, in order to ensure a sufficient feed of fuel into the combustion chamber 3, and during at least a part of the compression stroke 13, in order to ensure a feed of fuel into the crankcase interior 6. By virtue of the fuel valve 19 being activated in a manner dependent on the engine cycle, sufficient lubrication of the four stroke engine 1 and even running of the four stroke engine 1 can be ensured. The fuel valve 19 is opened at least once during every opening time interval E of the inlet valve 24. It is advantageous if, in each engine cycle, at least 20%, in particular at least 30%, preferably at least 40%, of the opening time interval T of the fuel valve 19 lies in the compression stroke 13. The fuel valve 19 is advantageously open over at least 20%, in particular at least 30%, preferably at least 40% of the compression stroke 13.

The four stroke engine 1 of the blower apparatus 50 (FIG. 4) preferably rotates at a rotational speed of approximately 5,000 to approximately 11,000 revolutions per minute, in particular of approximately 5,000 to approximately 9,000 revolutions per minute, at full load. It has been found that, in particular at such rather low rotational speeds at full load, the stated coordination of opening time $t_1$ and closing time $t_2$ with the engine cycle and in particular also with the opening time interval E of the inlet valve 24 (FIG. 3) is advantageous in order to ensure that, in every engine cycle, there is a sufficient fuel quantity present in the combustion chamber 3 (FIG. 1) such that a combustion can take place. Through the stated coordination of the opening time interval T of the fuel valve 19 with the crankshaft angle $\alpha$ (FIG. 3), sufficient lubrication of the crankcase interior 6 (FIG. 1) is also realized.

It is understood that the foregoing description is that of the preferred embodiments of the invention and that various changes and modifications may be made thereto without departing from the spirit and scope of the invention as defined in the appended claims.

What is claimed is:

1. A four stroke engine comprising:

a cylinder having a combustion chamber formed therein;

the four stroke engine being mixture-lubricated;

a piston mounted movably in said cylinder;

said combustion chamber being delimited by said piston;

a crankcase defining a crankcase interior;

a crankshaft mounted rotatably in said crankcase interior;

said piston being configured to drive said crankshaft in rotation;

an intake channel which discharges into said combustion chamber via an inlet opening;

an inlet valve configured to control said inlet opening;

an outlet channel leading out of said combustion chamber;

an outlet valve configured to control said outlet channel;

a mixture formation unit having at least one fuel opening which opens into said intake channel;

the four stroke engine having, for the lubrication of the crankcase interior, a flow connection which connects said intake channel to said crankcase interior via a connecting opening which opens into said intake channel downstream of said mixture formation unit;

a fuel valve configured to control a fuel quantity fed to said at least one fuel opening; and, a control unit configured to activate said fuel valve in a manner dependent on a position of said crankshaft such that said fuel valve is also opened during at least a part of a compression stroke of the four stroke engine, wherein said fuel valve is opened during at least part of the compression stroke while the inlet valve is closed.

2. The four stroke engine of claim 1, wherein said fuel valve is, in each engine cycle, opened both during at least a part of an intake stroke and during at least a part of the compression stroke.

3. The four stroke engine of claim 1, wherein said fuel valve is opened at least once during every opening time interval (E) of the inlet valve.

4. The four stroke engine of claim 1, wherein, in each engine cycle, at least 20% of an opening time interval (T) of said fuel valve lies in the compression stroke.

5. The four stroke engine of claim 1, wherein said mixture formation unit is a carburetor.

6. The four stroke engine of claim 5, wherein said carburetor has a venturi section; said at least one fuel opening is arranged in a region of said venturi section of said carburetor; and, fuel is drawn into said intake channel as a result of negative pressure prevailing in said intake channel.

7. The four stroke engine of claim 1, wherein said fuel valve is an electromagnetic valve.

8. The four stroke engine of claim 7, wherein said fuel valve is open when in an electrically deenergized state.

9. The four stroke engine of claim 7, wherein the fuel valve is closed when in an electrically deenergized state.

10. The four stroke engine of claim 1 further comprising:

a valve drive configured to activate said inlet valve and said outlet valve in a manner dependent on the position of said crankshaft;

said valve drive being arranged in a valve drive chamber; and, said valve drive chamber forming part of said flow connection.

11. The four stroke engine of claim 10, wherein said valve drive is configured as a lever-type drive; and, said valve drive chamber includes a lever chamber and at least one connecting channel which form parts of said flow connection.

12. A handheld work apparatus comprising:

a four stroke engine including a cylinder having a combustion chamber formed therein;

said four stroke engine being mixture-lubricated and further including a piston, a crankcase, an intake channel, an inlet valve, an outlet valve, an outlet channel, and a fuel valve;

said piston being mounted movably in said cylinder;

said combustion chamber being delimited by said piston;

said crankcase defining a crankcase interior;

a crankshaft mounted rotatably in said crankcase interior;

said crankshaft being configured to be driven in rotation by said piston;

wherein said intake channel discharges into said combustion chamber via an inlet opening;

said inlet valve being configured to control said inlet opening;

said outlet channel leading out of said combustion chamber;

said outlet valve being configured to control said outlet channel;

said four stroke engine further including a mixture formation unit having at least one fuel opening which discharges into said intake channel;

said four stroke engine having, for the lubrication of the crankcase interior, a flow connection which connects said intake channel to said crankcase interior via a connecting opening which discharges into said intake channel downstream of said mixture formation unit;

said fuel valve configured to control a fuel quantity fed to said at least one fuel opening;

said four stroke engine further having a control unit configured to activate said fuel valve in a manner dependent on a position of said crankshaft such that said fuel valve is also opened during at least a part of a compression stroke of said four stroke engine, wherein said fuel valve is opened during at least part of the compression stroke while the inlet valve is closed; and, said four stroke engine being configured to rotate at a rotational speed of 5000 to 11,000 revolutions per minute at full load.

13. A method for operating a four stroke engine, the four stroke engine including a cylinder having a combustion chamber formed therein, the four stroke engine being mixture-lubricated and further including a piston mounted movably in the cylinder, the combustion chamber being delimited by the piston, the four stroke engine further including a crankcase defining a crankcase interior and a crankshaft mounted rotatably in the crankcase interior, the crankshaft being configured to be driven in rotation by the piston, the four stroke engine having an intake channel which discharges into the combustion chamber via an inlet opening and an inlet valve configured to control the inlet opening, the four stroke engine further having an outlet channel leading out of the combustion chamber and an outlet valve configured to control the outlet channel, the four stroke engine further including a mixture formation unit having at least one fuel opening which discharges into the intake channel, the four stroke engine having, for the lubrication of the crankcase interior, a flow connection which connects the intake channel to the crankcase interior via a connecting opening which discharges into the intake channel downstream of the mixture formation unit, the four stroke engine having a fuel valve configured to control a fuel quantity fed to the at least one fuel opening; the method comprising the step of:

activating the fuel valve in a manner dependent on a position of the crankshaft such that the fuel valve is also opened during at least a part of a compression stroke of the four stroke engine, while the inlet valve is closed.

* * * * *